United States Patent [19]

von Zuben et al.

[11] Patent Number: 4,932,530

[45] Date of Patent: Jun. 12, 1990

[54] CONTAINER WITH INTEGRAL BLANK AND SEPARATE CORNER POST FASTENED THERETO

[75] Inventors: Fred G. von Zuben, Morristown; Robin P. Neary, Warren, both of N.J.

[73] Assignee: Book Covers Inc., Cranford, N.J.

[21] Appl. No.: 272,472

[22] Filed: Nov. 17, 1988

[51] Int. Cl.[5] ..... B65D 5/20

[52] U.S. Cl. ..... 206/491; 206/512; 229/120; 229/916; 229/918

[58] Field of Search ..... 206/504, 503, 505, 509, 206/511, 512, 518, 519, 491; 229/120, 915, 916, 918, 16 R

[56] References Cited

U.S. PATENT DOCUMENTS

| | | | |
|---|---|---|---|
| 2,713,962 | 7/1955 | Camp et al. | 229/918 |
| 2,894,672 | 7/1959 | Bamburg | 206/491 |
| 3,002,672 | 10/1961 | Kotowick | 229/16 R |
| 3,156,371 | 11/1964 | Harrison | 206/491 |
| 3,157,346 | 11/1964 | Hamilton | 229/915 |
| 4,151,948 | 5/1979 | de la Fuente, Jr. | 229/918 |
| 4,383,636 | 5/1983 | Chaffers | 206/509 |
| 4,685,610 | 8/1987 | Carter et al. | 229/916 |

*Primary Examiner*—Paul T. Sewell
*Assistant Examiner*—Jacob K. Ackun, Jr.
*Attorney, Agent, or Firm*—Erza Sutton

[57] ABSTRACT

An integral paperboard blank is provided for assembly with four corner posts to form a container for produce and the like. The corner posts are provided with nesting legs and slots so a plurality of containers can be stacked and nested. In addition, the container is provided with a flexible cover.

15 Claims, 4 Drawing Sheets

CONTAINER WITH INTEGRAL BLANK AND SEPARATE CORNER POST FASTENED THERETO

FIELD OF THE INVENTION

The present invention relates to a novel paperboard box and corner posts for assembling containers or boxes used for packaging and shipping fruit products, produce, and the like. More particularly, it is directed to an integral box component having a bottom panel, two side panels, and two end panels all integrally formed as one component for assembly with four corer posts into a complete container. The container thus formed has structural features which impart considerable strength to permit it to be stacked and/or nested with other similar containers containing considerable weight. In addition, when the boxes are stacked, the corner posts interlock and form continuous load-bearing columns for supporting the weight of the boxes and for maintaining proper spacing of the boxes to prevent the produce contained therein from being damaged when the boxes are stacked.

BACKGROUND OF THE INVENTION

Containers for packaging and shipping fruit and produce, such as grapes, are well known in the art. In the past, such containers or boxes used for this purpose, and their covers, have been made of wood, since wooden containers have sufficient strength to withstand being stacked and to also withstand storage in a humid environment. Typically, the wooden covers have wooden cleats at the ends thereof for attaching the wooden covers to the wooden end panels of the boxes.

In addition, another type of shipping container used in the past was formed from slats of wooden material covered and held together with paper, as shown, for example, in U.S. Pat. No. 3,905,478. However, because the bottom panel is formed of two or more separate wooden slats which are held together by paper, such a bottom panel has a tendency to bend and/or deform when subjected to the weight of the contents of the container.

Integral box components or blanks utilizing complete paperboard constructions are known, but these also have drawbacks. For example, the folding sections were formed only from wrapping paper and had no supporting paperboard sheets. Thus, the folding sections had a tendency to crease and collapse and did not have sufficient strength and rigidity. Moreover, the blanks included a bottom wall and sidewalls, but the end walls had to be provided separately, typically made of wood.

U.S. Pat. No. 4,685,610, assigned to the same assignee as this application, solved some of the foregoing problems, since the folding sections were formed of paperboard and provided increased strength and rigidity. However, the end panels consisted of wooden panels and were attached to the paperboard blank. Thus, a complete paperboard box still had not been achieved.

Broadly, it is an object of the present invention to provide an improved arrangement for forming a paperboard box for packaging and shipping fruit and other products, which overcomes one or more of the aforesaid drawbacks, has sufficient strength, rigidity, and stability, is recyclable, is moisture resistant, and can be stacked and nested with other similar boxes.

It is a further object of the present invention to provide an integral paperboard blank and four corner posts formed of paperboard which can be assembled into a complete paperboard container, wherein the integral blank includes in one unit the bottom panel, foldable side panels, and foldable end panels, and which is ready to be assembled with four corner posts and a cover to form a complete box. The box-forming blank of the present invention may be shipped in a flat configuration, ready to be assembled, which substantially reduces shipping and storage costs for such boxes It is a further object to form the corner posts, such that they provide for easy stacking and nesting of said boxes. When the boxes are stacked, the corner posts form continuous load-bearing columns for supporting the weight of the boxes.

It is still a further object of the present invention to provide a box-forming blank which, while having its various side and end panels foldable, can have the panels made as strong and rigid as desired.

SUMMARY OF THE INVENTION

Briefly, in accordance with the principles of the present invention, there is provided an improved integral paperboard blank having a bottom panel, a pair of folding side panels, and a pair of folding end panels, all formed as a single integral unit ready to be folded into a strong box or container. The paperboard blank is covered with inner and outer sheets of water-resistant paperboard material between which are secured one or more layers of rigid paperboard material. The side panels and end panels are foldable relative to the bottom panel to form a rigid box.

The present invention also includes four paperboard corner posts which are assembled with the paperboard blank to hold the box in the desired configuration. The corner posts also include features to perform the dual function of allowing the boxes to be stacked and nested.

Advantageously, as a result of the present invention, an improved integral paperboard blank is provided which is assembled with paperboard corner posts to provide a container formed completely of paperboard, which is moisture-proof and has sufficient strength, rigidity, and stability to be stacked. When the boxes are stacked, the corner posts form continuous load-bearing columns for supporting the weight of the boxes and for maintaining proper spacing of the boxes to prevent the produce contained therein from being damaged.

BRIEF DESCRIPTION OF THE DRAWINGS

Futher objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENTS

Figure 1:
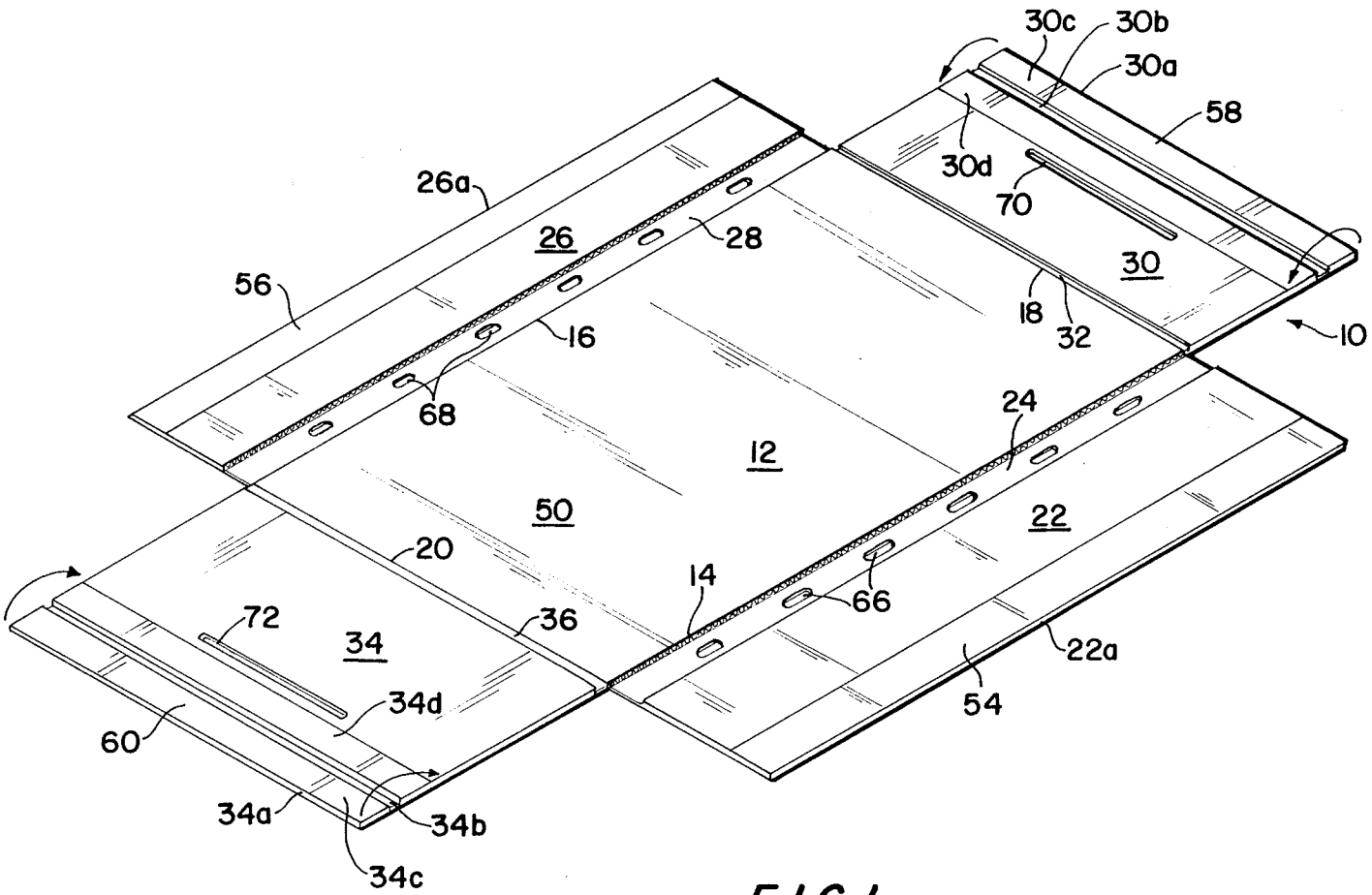
FIG. 1 is a perspective view of an integral paperboard blank in accordance with the present invention.

As shown in FIG. 1, a container embodying the invention is formed from a blank 10 which comprises layers of paperboard material. The blank 10 is made up of a bottom panel 12 having a first side edge 14, a second side edge 16, a first end edge 18, and a second end edge 20. The blank 10 further includes an integral first side panel 22 which is foldably connected by a folding section 24 to the bottom panel 12 along first side edge 14. A similar integral second side panel 26 is foldably connected by a folding section 28 to the bottom panel 12 along second side edge 16. The blank 10 further includes an integral first end panel 30 foldably connected about a folding groove 32 to bottom panel 12 along first end edge 18. Similarly, an integral second end panel 34 is foldably connected about a folding groove 36 to bottom panel 12 along second end edge 20.

As an alternative embodiment, side panels 22 and 26 may be foldably and integrally connected to side edges 14 and 16 by folding grooves (similar to folding grooves 32 and 36) instead of employing folding section 24 and 28. In such an embodiment, the ventilation holes 66 and 68 would be formed in side panels 22 and 26.

Figure 2:
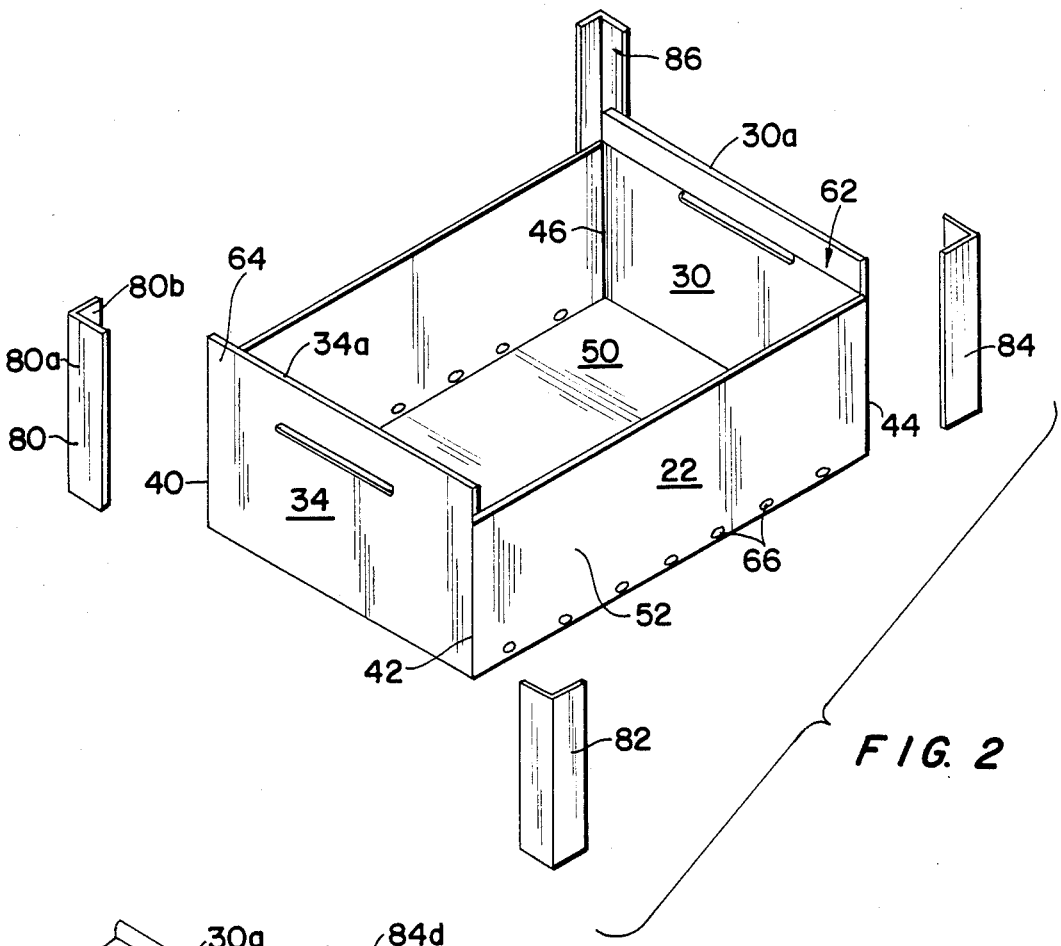
FIG. 2 is a perspective view illustrating the integral blank of FIG. 1 in its folded configuration to form a box, with the corner posts ready to be fastened thereto.

In the preferred embodiment, paperboard blank 10 is formed to include three plies of paperboard in all sections, except in folding sections 24 and 28 and in grooves 32 and 36. More particularly, blank 10 is formed from an integral ply of paperboard having superimposed thereon two additional plies of paperboard to form bottom panel 12, side panels 22 and 26, and end panels 30 and 34. Thus, in folding sections 24 and 28, there is only one ply of paperboard, and grooves 32 and 36 (approximately $\frac{1}{4}''$ in width) are formed by cutting through the two top paperboard plies and partially into the bottommost ply. In this manner, side panels 22 and 26 and end panels 30 and 34 may be easily folded upwardly to form a four-sided container having four (4) upright and vertical corners 40, 42, 44, and 46, as shown in FIG. 2. In the preferred embodiment, each ply of paperboard has a thickness of 42 points, for a total of 126 points. However, the thickness may vary between 100 to 160 points.

In the preferred embodiment, blank 10 is covered with inner and outer layers 50 and 52 of moisture-proof liner paper, having a thickness of 10 points each, in the preferred embodiment. As shown in FIG. 1, the outer liner 50 covering the outside of the contained is folded over onto the insides of side panels 22 and 26 to form overlaps 54 and 56, so that the outer edges **22*a* and 26*a* of side panels 22 and 26 are not exposed to moisture. A similar arrangement is applied to end panels 30 and 34. That is, outer liner 50 is folded over onto the insides of end panels 30 and 34 to form overlaps 58 and 60, so that outer edges 30*a* and 34*a* of end panels 30 and 34** are not exposed to moisture.

In this manner, in the preferred embodiment, folding sections 24 and 28 are formed from one ply of paperboard, covered on both sides by inner and outer layers 50 and 52 of liner. In the preferred embodiment, folding sections 24 and 28 are provided with ventilation holes 66 and 68 to allow air to circulate through the container when it is filled with produce or other contents.

In addition, in the preferred embodiment, end panel 30 is provided with a transverse groove **30*b* to form section 30*c*, which is folded over onto section 30*d* to form an end panel having a reinforced section 62. (See FIG. 2.) Similarly, end panel 34 is provided with a transverse groove 34*b* to form section 34*c*, which is folded over onto section 34*d* to form an end panel having a reinforced section 64**. (See FIG. 2.)

Further, end panels 30 and 34 are provided with cutouts 70 and 72 for receiving a cover or lid, in a manner to be explained.

As shown in FIG. 2, the four upright corners 40, 42, 44, and 46 are provided with respective corner posts 80, 82, 84, and 86. Each corner post is formed of laminated plies of paperboard formed into right angles. Each corner post has a first section, such as **80*a*, for overlapping an end panel, and a second section 80*b*** for overlapping a side panel. In the preferred embodiment, each of the corner posts is covered with a moisture-proof liner material to prevent the corner posts from absorbing moisture and becoming weakened.

Each corner post has at least five plies of paperboard and may have up to nine plies, having a total thickness of 200 or 210 points. The preferred thickness is in the range of 200 to 260 points.

Figure 3:
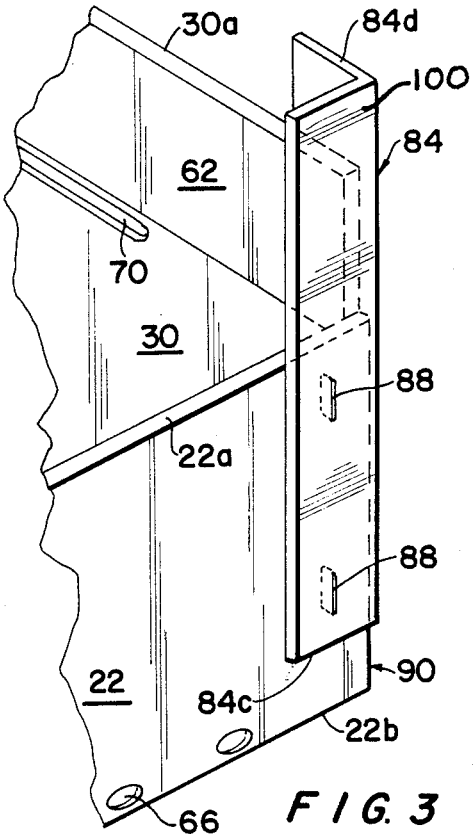
FIG. 3 is a perspective view, in detail, of a corner post fastened to one of the corners of the box shown in FIG. 2.
Figure 4:
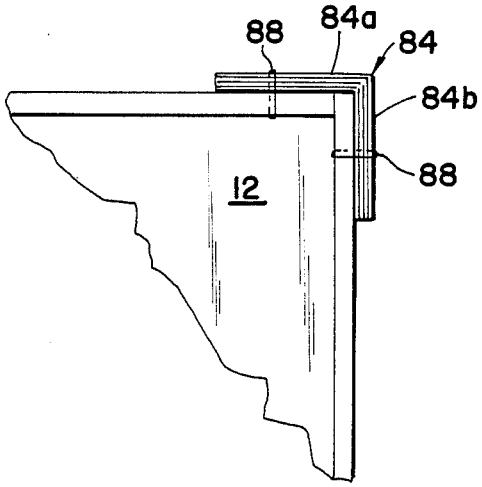
FIG. 4 is a top view, showing in detail the corner post fastened to the box.

As shown in FIG. 3, corner post 80 is attached to the container by staples 88 or any other suitable means, such as rivets, glue, hot or cold adhesive, or wire stitching. The other corner posts 82, 84, and 86 are also attached to the container in the same manner.

The corner posts 80, 82, 84, and 86 are attached to the four corners of the container in a manner which forms stacking and nesting means. More particularly, as shown in FIG. 3, corner post 84 has a bottom edge **84*c* which is spaced from the bottom edge 22*b* of side panel 22 and which is spaced from the bottom edge 30*b* of end panel 30 to form a corner nesting slot 90. Similarly, the bottom of each corner post 80, 82, and 86 forms corner nesting slots 92, 94, and 96** on the bottom corners of the container. In the preferred embodiment, each corner nesting slot is one-fourth inch in height but can be in the range of one-eighth to one-half inch.

The corner posts 80, 82, 84, and 86 are attached to the four corners of the container in a manner to form four corner nesting legs 100, 102, 104, and 106. More particularly, as shown in FIG. 3, corner post 84 has a top edge **84*d* which is spaced from the top edge 30*a* of end panel 30 to form corner nesting leg 100. Similarly, the top of each corner post 80, 82, and 86 forms corner nesting legs 102, 104, and 106 on the top corners of the container. In the preferred embodiment, the corner nesting legs extend above end panel 30 or 34** approximately one-fourth inch but can be in the range of one-eighth to one-half inch.

Figure 7:
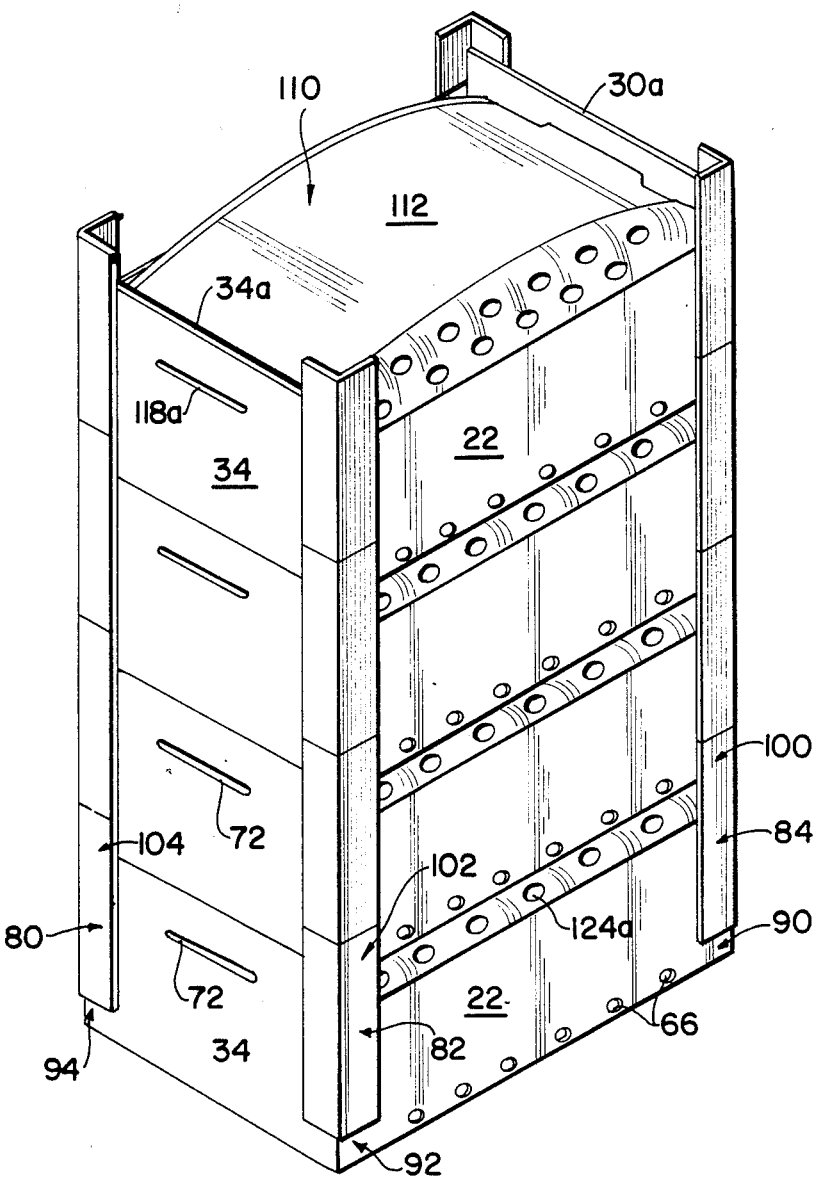
FIG. 7 is a perspective view of a stack of boxes nested and stacked in accordance with the present invention.

In this manner, as shown in FIG. 7, the containers may be easily stacked, with the corner nesting legs 100, 102, 104, and 106 of one container being received within the corner nesting slots 90, 92, 94, and 96 of the container stacked above it. In addition, as will also be understood, the top edges **30*a* and 34*a* of end panels 30 and 34 receive and support the container stacked above it, since the bottom edges of the end panels of the upper container rest upon the top edges 30*a* and 34*a*** of the container below.

Figure 5:
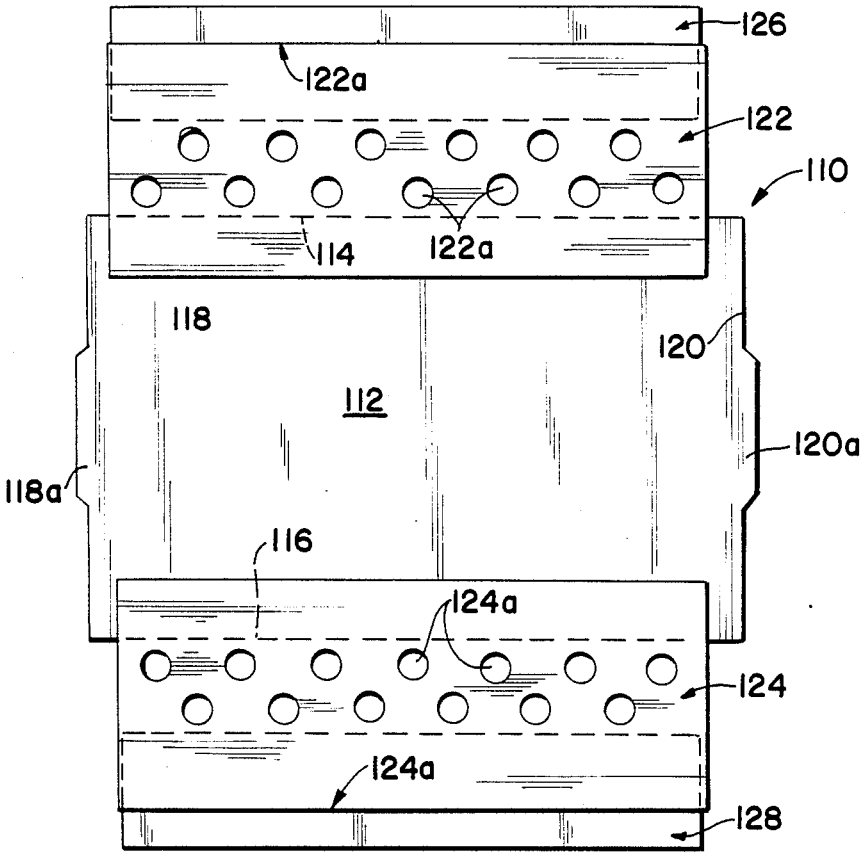
FIG. 5 is a top plan view of the novel cover of the present invention.
Figure 6:
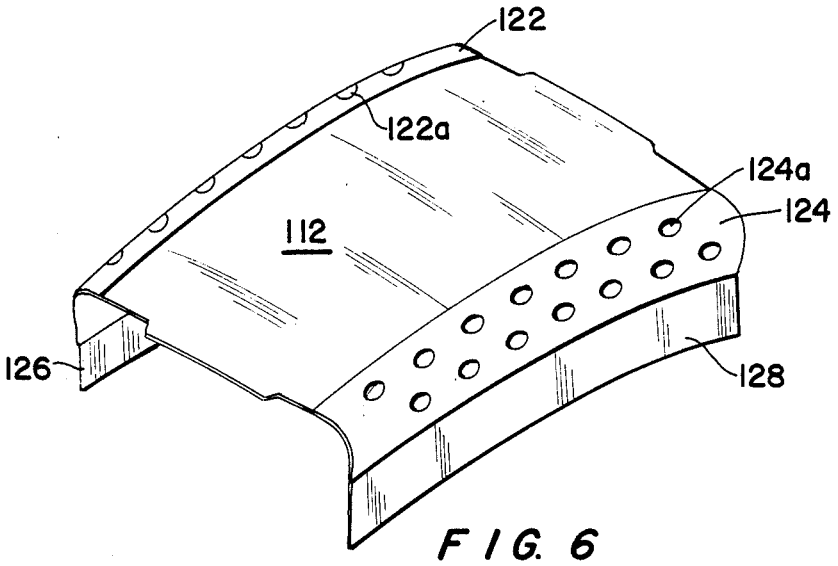
FIG. 6 is a perspective view of the cover in the configuration it assumes when inserted in the box of the present invention.

Turning now to FIGS. 5 and 6, there is shown the novel snap-in cover or lid 110 of the present invention.

The cover 110 includes a central panel 112 formed of flexible or bendable paperboard having first and second side edges 114 and 116, and first and second end edges 118 and 120. A strip of paper 122 is attached, by glue or the like, along side edge 114 to panel 112, and a strip of paper 124 is attached along side edge 116. In addition, a strip of paperboard 126 is attached, by glue or the like, along the outer edge 122*a* of paper strip 122. A strip of paperboard 128 is attached along the outer edge 124*a* of paper strip 124. In the preferred embodiment, paper strips 122 and 124 are provided with ventilation holes 122*a* and 124*a* to allow air to circulate through the container.

The end edges 118 and 120 of panel 112 are provided with lips or extension members 118*a* and 120*a*. In this manner, the cover 110 is flexed or bent and draped over the container, with the lips 118*a* and 120*a* being inserted into the respective slots 70 and 72 to hold the cover in place. In addition, as shown in FIG. 7, when the containers are stacked, the cover 110 does not interfere with the stacking. Further, the side panels 22 and 26 are not as high as the end panels 30 and 34 to allow for the circulation of air through ventilation holes 122*a* and 124*a* in cover 110.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A box formed of paperboard, comprising:

a bottom panel having first and second side edges and first and second end edges;

first and second side panels foldably and integrally connected to said first and second side edges, respectively, by first and second folding sections;

said first and second folding sections having a thickness which is less than half the thickness of said side panels to allow said side panels to be folded relative to said bottom panel;

said first and second folding sections having ventilation slots formed therein;

first and second end panels foldably and integrally connected to said first and second end edges, respectively;

each of said first and second end panels having a groove formed at the bottom thereof to allow said first and second end panels to be folded relative to said bottom panel;

said first and second side panels and said first and second end panels being folded into an upright position to form four sidewalls and four upright corners;

four corner posts formed of paperboard and each fastened to a respective one of said four upright corners;

each of said corner posts overlapping the outer surfaces of an adjacent side panel and end panel;

each of said four corner posts having a bottom edge which is spaced from the bottom edge of said four upright corners to define four corner nesting slots at the four bottom corners of said box;

each of said four corner posts having a top edge which is spaced above the top edge of said four upright corners to define four corner nesting legs at the four top corners of said box; and each of said four corner nesting slots adapted to receive and nest the four corner nesting legs from another box when said box is stacked above said another box the corner posts of the stacked boxes being vertically aligned, whereby said corner posts form continuous load-bearing columns for supporting the weight of said boxes and for maintaining the spacing of said boxes.

2. A box in accordance with claim 1 wherein the inner and outer surfaces of said bottom panel, said first and second side panels, said first and second end panels, and said first and second folding sections are covered with a moisture-resistant lining material.

3. A box in accordance with claim 1 wherein each of said first and second end panels has a slot formed therein for receiving a snap-in cover.

4. A box in accordance with claim 1 wherein the upper section of each of said first and second end panels has a wall thickness which is double the thickness of the remaining portions of said first and second end panels to provide enhanced rigidity and support for said box when it is stacked.

5. A box in accordance with claim 1 wherein said bottom panel, said first and second side panels, said first and second end panels, and said first and second folding sections include a single integral base ply of paperboard having one or more plies of paperboard laminated thereto to form said bottom panel, said first and second side panels, and said first and second end panels.

6. A box in accordance with claim 1 wherein said four corner posts are formed from a plurality of plies of paperboard covered with a moisture-resistant lining material.

7. A box in accordance with claim 1 wherein said corner nesting slots are of the same height as said corner nesting legs.

8. A box in accordance with claim 7 wherein said corner nesting slots and said corner nesting legs have a preferred height of one-fourth of one inch.

9. A box in accordance with claim 1 wherein said corner posts have a substantially right angle shape.

10. A box in accordance with claim 1 wherein said corner posts are attached to said upright corners by staples.

11. A box in accordance with claim 1 wherein said corner posts are attached to said upright corners by rivets.

12. A box in accordance with claim 1 wherein said corner posts are attached to said upright corners by glue.

13. A box in accordance with claim 1 wherein said end panels are higher than said side panels so that the top edges of said end panels cooperate with said corner posts to form seats for receiving a box to be nested above it.

14. A box formed of paperboard, comprising:

a bottom panel having first and second side edges and first and second end edges;

first and second side panels foldably and integrally connected to said first and second side edges, respectively;

first and second end panels foldably and integrally connected to said first and second end edges, respectively;

said first and second side panels and said first and second end panels being folded into an upright position to form four sidewalls and four upright corners;

four corner posts formed of paperboard and each fastened to a respective one of said four upright corners;

each of said corner posts overlapping the outer surfaces of an adjacent side panel and end panel;

each of said four corner posts having a bottom edge which is spaced from the bottom edge of said four upright corners to define four corner nesting slots at the four bottom corners of said box;

each of said four corner posts having a top edge which is spaced above the top edge of said four upright corners to define four corner nesting legs at the four top corners of said box; and each of said four corner nesting slots adapted to receive and nest the four corner nesting legs from another box when said box is stacked above said another box the corner posts of the stacked boxes being vertically aligned, whereby said corner posts form continuous load-bearing columns for supporting the weight of said boxes and for maintaining the spacing of said boxes.

15. A cover for a stackable shipping box, comprising:

a central panel formed of bendable paperboard having first and second side edges and first and second end edges;

a first strip of paper attached along said first side edge to said central panel and a second strip of paper attached along said second side edge to said central panel;

a first strip of paperboard attached to the outer edge of said first strip of paper and a second strip of paperboard attached to the outer edge of said second strip of paper;

said first and second strips of paper having ventilation holes formed therein; and each of said first and second end edges of said central panel having extension members formed therein adapted to engage slots formed in the end panels of a box to be covered.

* * * * *

UNITED STATES PATENT AND TRADEMARK OFFICE

CERTIFICATE OF CORRECTION

PATENT NO. : 4,932,530

DATED : June 12, 1990

INVENTOR(S) : Fred G. von Zuben and Robin P. Neary

It is certified that error appears in the above-identified patent and that said Letters Patent is hereby corrected as shown below:

Column 1, line 2, change "Post" to --Posts--.

Column 1, line 12, change "corer" to --corner--.

Column 3, line 55, change "contained" to --container--.

Signed and Sealed this

Sixteenth Day of July, 1991

*Attest:*

HARRY F. MANBECK, JR.

*Attesting Officer*

*Commissioner of Patents and Trademarks*